US010995994B2

(12) United States Patent
DeLugan et al.

(10) Patent No.: US 10,995,994 B2
(45) Date of Patent: May 4, 2021

(54) OUTLET HEADER OF HEAT EXCHANGER

(71) Applicant: HAMILTON SUNDSTRAND CORPORATION, Windsor Locks, CT (US)

(72) Inventors: Anthony DeLugan, Feeding Hills, MA (US); Diana Shiroma, Hartford, CT (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 842 days.

(21) Appl. No.: 14/230,798

(22) Filed: Mar. 31, 2014

(65) Prior Publication Data

US 2015/0276331 A1 Oct. 1, 2015

(51) Int. Cl.

| | |
|---|---|
| ***F28F 9/00*** | (2006.01) |
| ***F28D 1/04*** | (2006.01) |
| ***F28F 9/02*** | (2006.01) |
| *F28D 21/00* | (2006.01) |

(52) U.S. Cl.

CPC ..... *F28D 1/0443* (2013.01); *F28F 9/02* (2013.01); *F28D 2021/0021* (2013.01); *F28F 2009/029* (2013.01); *F28F 2250/06* (2013.01)

(58) Field of Classification Search

CPC .. F28F 1/00; F28F 2250/06; F28F 2009/0285; F28F 2009/0295; F28F 2009/90256; F28F 2009/0256; F28D 2021/0021; F28D 1/0233; F28D 1/00; F28D 15/00; F16L 41/02; F16L 41/086; F16L 43/00; F16L 43/008; F16L 43/02; B64D 13/06; B64D 37/32; B64D 2013/06776

See application file for complete search history.

(56) References Cited

U.S. PATENT DOCUMENTS

| | | | | | |
|---|---|---|---|---|---|
| 1,566,439 | A * | 12/1925 | Smith | A47L 17/00 | 15/74 |
| 2,686,685 | A * | 8/1954 | Shoemaker | F16L 27/1017 | 285/119 |
| 3,681,200 | A * | 8/1972 | Ridgway | C12M 27/24 | 261/77 |
| 3,909,045 | A * | 9/1975 | Meagher | F16L 13/11 | 285/22 |
| 5,209,290 | A * | 5/1993 | Chigira | F28F 9/002 | 165/149 |
| 2006/0235191 | A1* | 10/2006 | Deininger | C08G 69/04 | 528/310 |
| 2013/0284409 | A1* | 10/2013 | Odillard | F28D 9/0043 | 165/109.1 |
| 2014/0305158 | A1* | 10/2014 | Kouno | F25B 39/04 | 62/506 |

* cited by examiner

*Primary Examiner* — Travis C Ruby
*Assistant Examiner* — Harry E Arant
(74) *Attorney, Agent, or Firm* — Cantor Colburn LLP

(57) ABSTRACT

An outlet header of a heat exchanger is provided. The outlet header defines a flow-tap-off duct and includes an L-tube. The L-tube defines first and second legs. The first leg is fasteningly installed in the flow-tap-off duct such that the second leg is directed toward a cold-cold corner of the heat exchanger. The second leg is configured to capture cool air from the cold-cold corner for providing the cool air to and through the flow-tap-off duct and exterior the heat exchanger.

9 Claims, 2 Drawing Sheets

OUTLET HEADER OF HEAT EXCHANGER

BACKGROUND OF INVENTION

This invention relates, generally, to environmental-control systems (ECS) for an aircraft and, more specifically, to an air-conditioning system thereof.

In an aircraft, fuel-and-air mixtures (known as "ullage") in air space in a fuel tank of the aircraft can be, for example, flammable and, thus, dangerous. To minimize this possibility, an on-board inert-gas-generating system ("OBIGGS") can be used on the aircraft.

More specifically, the OBIGGS dilutes the ullage by reducing its content of oxygen and adds nitrogen-enriched air (NEA) to it. In particular, the OBIGGS separates the oxygen from ambient air and pumps relatively inert oxygen-impoverished NEA to the fuel tank. The OBBIGS may produce the NEA by using an air-separation module ("ASM") of the OBIGGS. The ASM operates most efficiently—in terms of permeability of the oxygen through the ASM—at an elevated temperature (usually in an optimal range of about 180° to about 210° F.).

Compressed or pressurized (high-temperature) air is used for generation of the NEA. Toward that end, the aircraft includes a typical ECS in a form of an air-conditioning machine, pack, or system mounted to an outside of a pressure vessel of the aircraft. The pressurized air usually originates from either bleeding of an engine of the aircraft ("bleed air") or another source of pressure within the aircraft. The bleed air is hotter and usually processed (cooled) by going through a heat exchanger.

More specifically, the heat exchanger is a dual air-to-air heat exchanger and includes integral primary and secondary heat exchangers that share with each other a cool-air source. The hot circuit of the primary heat exchanger is sourced by the bleed air and cooled by ambient standing air that is drawn by a fan or forced "ram" air from another cooling-air source. The primary heat exchanger provides cooled air to a remainder of the air-conditioning system through an outlet duct of the primary heat exchanger. The primary heat exchanger provides cooled air to the OBIGGS through a smaller flow-tap-off duct of an outlet header of the primary heat exchanger. A longer conduit is operatively connected to and between the tap-off duct and OBIGGS, and the cooled air flows from the heat exchanger to the OBIGGS through the longer conduit.

However, the heat exchanger may not sufficiently cool the pressurized air (i.e., within the optimal temperature range before the cooled air is vented to the OBIGGS). More specifically, while the ambient air is satisfying a flow requirement of a maximum operating condition of, say, 122° F., an upper limit of 210° F. for the cooled air to the OBIGGS may be exceeded.

In this way, a minimum temperature of the air delivered to the OBIGGS is above the optimal temperature range to run the OBIGGS efficiently. So, even though the pressurized air passes through the primary heat exchanger and the cooling air from the cooling-air source passing through the primary heat exchanger can be modulated, the temperature of the air delivered to the OBIGGS may be above 210° F.

Accordingly, it is desirable to provide an air-conditioning system of an aircraft that delivers air to the OBIGGS within the optimal temperature range. More specifically, it is desirable to provide a retrofit solution to the "over-temperature" condition of the air exiting the flow-tap-off duct of the outlet header of the heat exchanger and being routed to the OBIGGS.

BRIEF DESCRIPTION OF INVENTION

According to a non-limiting embodiment of the invention, an outlet header of a heat exchanger defines a flow-tap-off duct and includes an L-tube. The L-tube defines first and second legs. The first leg is installed in the flow-tap-off duct with fasteners such that the second leg is directed toward a cold-cold corner of the heat exchanger. The second leg is configured to capture cool air from the cold-cold corner for providing the cool air to and through the flow-tap-off duct and exterior the heat exchanger.

BRIEF DESCRIPTION OF DRAWING

The subject matter that is regarded as the invention is particularly pointed out and distinctly claimed in the claims at the conclusion of the specification. The foregoing and other features and advantages of the invention are apparent from the following detailed description taken in conjunction with the accompanying drawing in which:

DETAILED DESCRIPTION OF INVENTION

Figure 1:
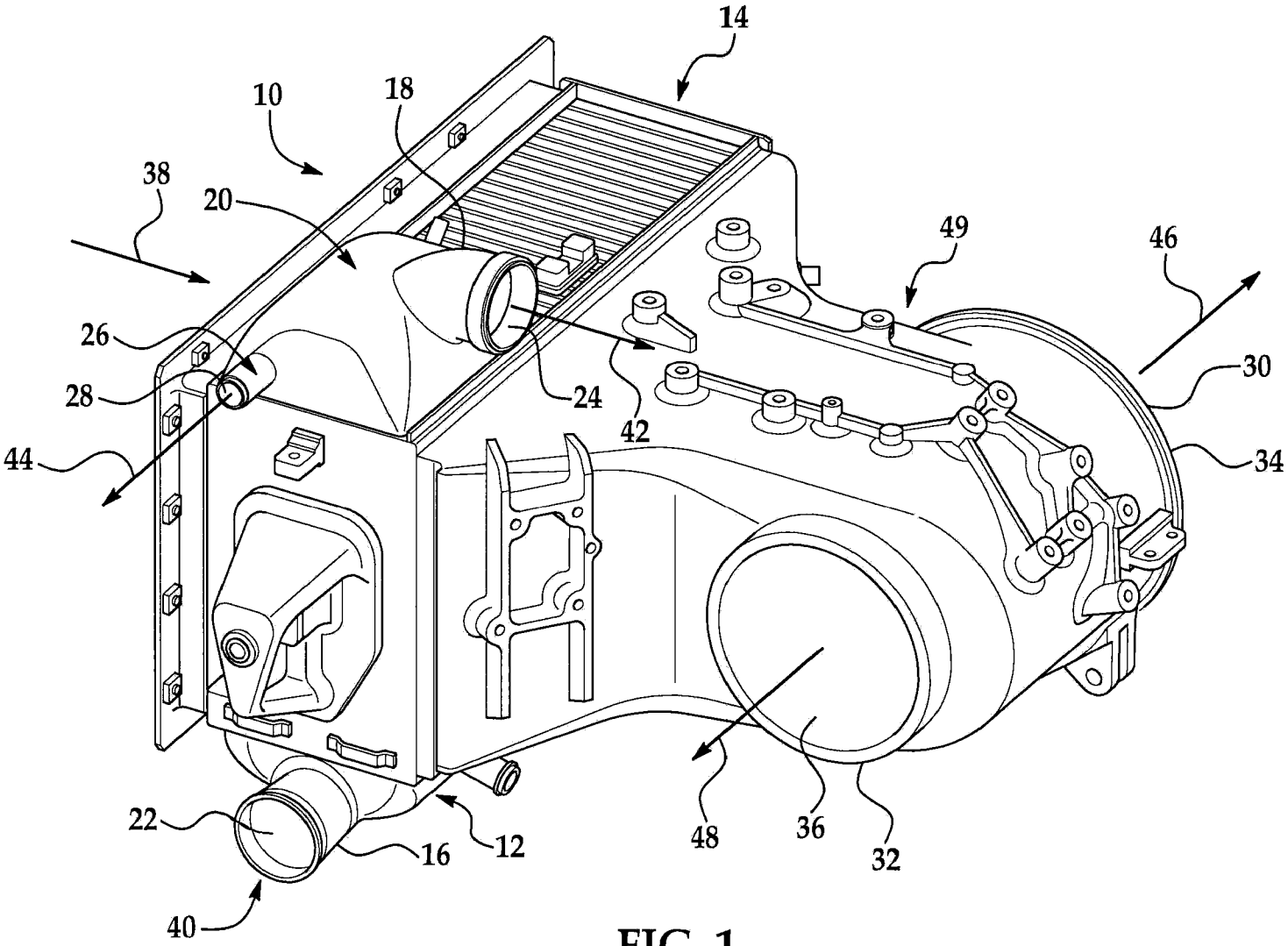
FIG. 1 is a perspective top view of an exemplary dual air-to-air heat exchanger including integral primary and secondary heat exchangers that share with each other a cooling-air source.

Referring now to FIG. 1, an example of a heat exchanger is shown at 10. The heat exchanger 10 shown in the figure and described below is configured for use with a typical environmental-control system (ECS) in a form of an air-conditioning machine, pack, or system mounted to an outside of a pressure vessel of an aircraft. The air-conditioning system works to supply conditioned air to other parts of the aircraft at proper pressure and temperature. However, it should be appreciated that the heat exchanger 10 can be configured for use with any suitable aircraft- or non-aircraft-related system.

More specifically, the heat exchanger 10 is a dual air-to-air heat exchanger 10 and includes integral primary and secondary heat exchangers 12, 14 connected in series and sharing a cooling-air source with each other. The primary heat exchanger 12 defines a primary bleed duct or conduit 16, a primary conduit 18, and an outlet header 20. The primary bleed conduit 16, primary conduit 18, and outlet header 20, in turn, define respectively a primary bleed inlet 22, primary outlet 24, and smaller flow-tap-off duct 26. The flow-tap-off duct 26, in turn defines a flow-tap-off outlet 28.

A single-source ram-outlet circuit defines a fan- or ACM-air conduit 30 and ram-exhaust conduit 32 (ACM stands for "air-cycle machine"). The ACM-air conduit 30 and ram-exhaust conduit 32, in turn, define respectively an ACM-air outlet 34 and ram-exhaust outlet 36. Ram air from the primary and secondary heat exchangers 12, 14 mix in a fan-inlet-diffuser housing (FIDH).

Straight arrows shown in the figure schematically represent direction of flow of air to, through, and/or from the respective conduits 16, 18, 26, 30, 32, inlets 22, and outlets 24, 28, 34, 36 of the primary and secondary heat exchangers 12, 14. As described in greater detail below, ambient or ram air 38 flows to and through a front of the primary heat exchanger 12, compressed or pressurized (high-temperature) air 40 flows to and through the primary bleed conduit 16 and inlet 22, cooled air 42 flows through and from the primary duct 18 and outlet 24, cooled air 44 flows through and from the flow-tap-off duct 26 and outlet 28, air flows 46 through and from the ACM-air conduit 30 and outlet 34, and air flows 48 through and from the ram-exhaust conduit 32 and outlet 36.

The heat exchanger 10 receives the compressed air 40 from an engine of the aircraft at the primary bleed inlet 22. Typically, the air 40 is bled off the engine ("bleed air") and compressed, whereby the air 40 goes through regulating valves (not shown) to set a pressure of the air 40. The bleed air 40 goes into the primary heat exchanger 12, where the bleed air 40 is cooled using a ram-air fan (not shown). The ram-air fan typically draws the ram air 38 from outside the aircraft into the heat exchanger 10 to cool primary airflow or process-flow air (e.g., the bleed air 40) and then exhausts the cooling ram air through the air flow 46 to the fan through the ACM-air conduit 30, which finally exhausts the air flow 48 exterior of the aircraft through the ram-exhaust outlet 36. The ram air 38 acts to cool the bleed air 40 entering the primary heat exchanger 12. The primary heat exchanger 12 can cool the process-flow air, for example, from about 400° F. to about 200° F. Air is then transferred to the secondary heat exchanger 14, which also uses the ram air 38 to cool the primary airflow further, for example, from about 350° F. to about 150° F. It should be appreciated that ambient standing air can be drawn by a fan as well.

The heat exchanger 10 can be fabricated from aluminum or any other metal that can withstand operating temperatures and stresses.

Figure 2:
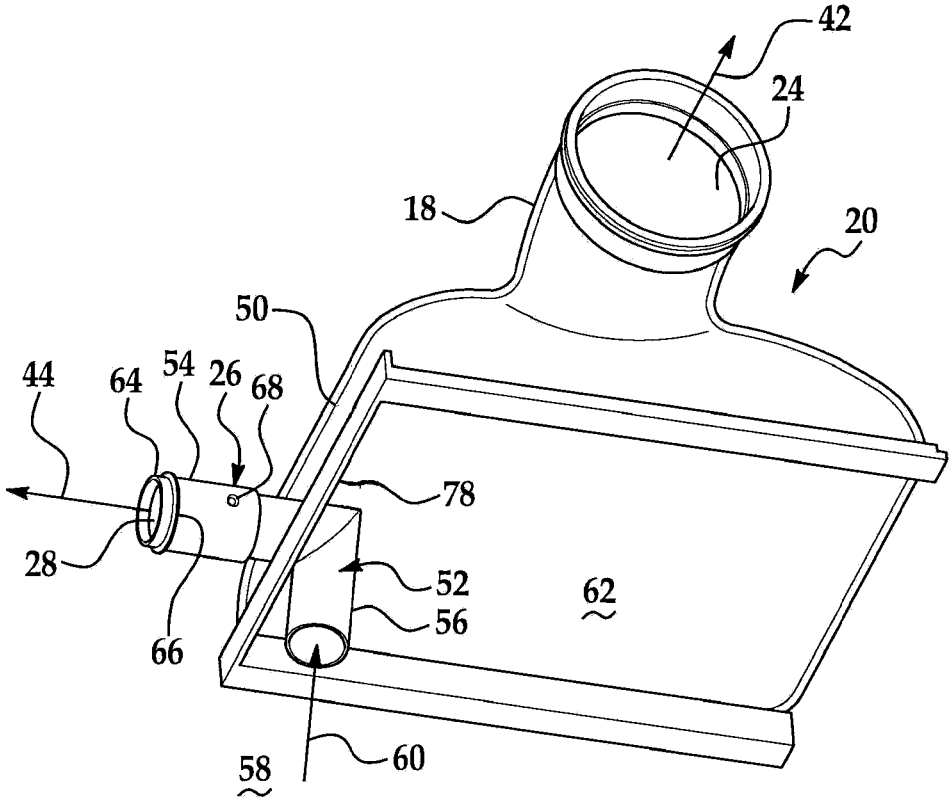
FIG. 2 is a perspective bottom view of a non-limiting embodiment of an outlet header according to the invention with a partial "OBIGGS" duct attached thereto.

Referring now to FIG. 2, a non-limiting embodiment of the outlet header 20, according to the invention, is shown. As can be seen, the flow-tap-off duct 26 extends integrally and substantially linearly from an exterior side 50 of the outlet header 20 and substantially perpendicular to the side 50. In FIG. 1, the flow-tap-off duct 26 is shown positioned on an end of the side 50 located adjacent to the front of the heat exchanger 10, and the side 50 is shown positioned on a same side of the heat exchanger 10 as is the primary bleed conduit 16. In this way, the side 50 is located substantially close to the cool-air source/ram air 38 upon entrance of the ram air 38 into the primary heat exchanger 12.

In general, an L-tube 52 defines first and second legs 54, 56. The first leg 54 is fasteningly installed in the flow-tap-off duct 26 such that the second leg 56 is directed toward a cold-cold corner 58 of the heat exchanger 10 and configured to capture cool air 60 from the cold-cold corner 58 for providing the cool air 60 to and through the flow-tap-off duct 26 and exterior the heat exchanger 10.

Figure 3:
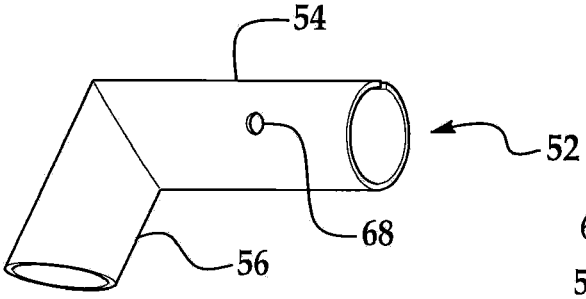
FIG. 3 is a side view of a non-limiting embodiment of an L-tube of the outlet header according to the invention illustrated in FIG. 2.
Figure 4:
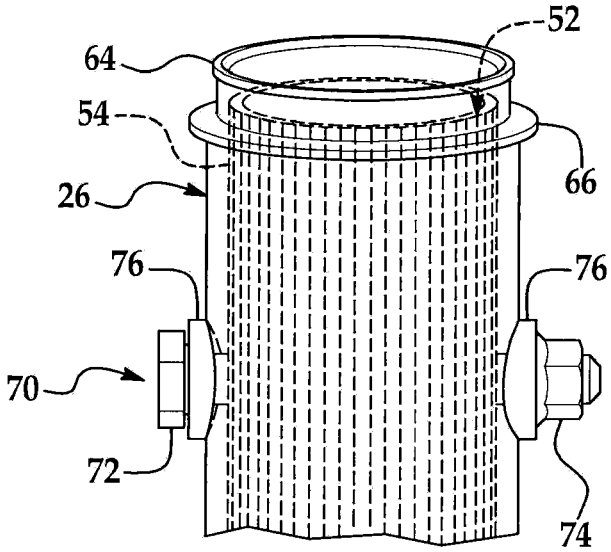
FIG. 4 is a partial side view of the outlet header according to the invention illustrated in FIG. 2 showing the first leg of the L-tube fasteningly installed in the flow-tap-off duct.

More specifically and referring now to FIGS. 2 through 4, the first leg 54 is longer than the second leg 56. The first and second legs 54, 56 are substantially uniform and formed at a substantial right angle with respect to each other such that the first and second legs 54, 56 meet each other at substantially sharp corners. The first and second legs 54, 56 also define a substantially circular cross-section.

The first leg 54 is matingly received in the flow-tap-off duct 26 such that a first end of the first leg 54 sits slightly inboard of a free end of the flow-tap-off duct 26 and a second end of the first leg 54 extends at least slightly into an interior 62 of the outlet header 20. The free end of the flow-tap-off duct 26 defines a flange 66 slightly inboard of a lip 64. At least one hole 68 is defined in the first leg 54 and configured to receive a fastener 70 for mechanically installing the L-tube 52 to the flow-tap-off duct 26 and, thus, outlet header 20. In an aspect of the embodiment, a pair of opposed holes 68 (only one shown in the figures) are so defined. In FIG. 4, the fastener 70 is a combination of a bolt 72, nut 74, and two curved washers 76. Epoxy, for example, can be used to fill any gaps between the first leg 54 and flow-tap-off duct 26 in the installation and act as a secondary form of retention between the first leg 54 and flow-tap-off duct 26. Also, the L-tube 52 is configured to be retrofitted to an existing flow-tap-off duct 26.

It should be appreciated that the fastener 70—for instance, in a retrofit application—can be a rivet in each hole 68 (not shown) or a combination of a through-bolt with curved bushings and corresponding washers (not shown). It should be appreciated also that the L-tube 52 can be adhesively installed (e.g., sealed with epoxy) or welded to the flow-tap-off duct 26.

The second leg 56 is positioned within the interior 62 of the outlet header 20 and spaced from an interior side 78 of the outlet header 20. The second leg 56 extends downwardly to at least a bottom portion of the outlet header 20 and is situated just above a surface of the primary heat exchanger 12, where the cold-cold corner 58 is located. In particular, the cold-cold corner is defined by a volume of an interior of the primary heat exchanger 12 that is located most closely to the cool-air source/ram air 38 upon entrance of the ram air 38 into the primary heat exchanger 12 and opposite a source of hot-air flow upon entrance of the bleed air 40 into the primary heat exchanger 12.

In operation, the bleed air 40 is used for generation of nitrogen-enriched air (NEA). A primary or hot circuit of the primary heat exchanger 12 is sourced by the bleed air 40 and cooled by the ram air 38 that is drawn by the ram-air fan and passes through the primary heat exchanger 12. The primary heat exchanger 12 provides cooled air 42 to a remainder of the air-conditioning system through the primary duct 18 and outlet 24. The L-tube 52 captures the cool air 60 from the cold-cold corner 58 and provides the cool air 60 to and through the flow-tap-off duct 26 as the cooled air 44. The primary heat exchanger 12 provides the cooled air 44 to an on-board inert-gas-generating system ("OBIGGS") (not shown) through the flow-tap-off duct 26 and outlet 28. A longer conduit (not shown) is operatively connected to and between the tap-off duct 26 and OBIGGS, and the cooled air 44 flows from the heat exchanger 10 to the OBIGGS through the longer conduit. A temperature of the cooled air 44 in the longer conduit en route to the OBIGGS is required to be no greater than about 210° F.

It should be appreciated that the L-tube 52 can have any suitable shape, size, and structure and have any suitable relationship with the flow-tap-off duct 26 and outlet 28, in particular, and outlet header 20 and primary heat exchanger 12, in general. It should be appreciated also that the first and second legs 54, 56 can have any suitable relationship with each other. It should be appreciated also that the L-tube 52 can be fasteningly installed in the flow-tap-off duct 26 in any suitable manner. It should be appreciated also that the L-tube 52 can be directed toward the cold-cold corner 58 in any suitable manner such that the L-tube 52 can capture the cool air 60 from the cold-cold corner 58 by any suitable means. It should be appreciated also that the L-tube can be made of any suitable material.

With the heat exchanger 10, an air-conditioning system of an aircraft can be provided that delivers air to the OBIGGS within an optimal temperature range. More specifically, the heat exchanger 10 provides a retrofit solution to an "over-temperature" condition of the cooled air 44 exiting the flow-tap-off duct 26 of the outlet header 20 of the heat exchanger 12 and being routed to the OBIGGS. Also, the heat exchanger 10 provides such a solution without requiring destructive re-work to the heat exchanger 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat exchanger, which is a dual air heat exchanger for an aircraft, comprising:

a front side and a top side, the front side facing a first direction and being a ram air inlet for receiving ram air flowing in the first direction, the top side being an outlet of a primary heat exchanger disposed within the heat exchanger, wherein the top side faces a second direction that is perpendicular to the first direction, an outlet header disposed against the top side of the heat exchanger and covering a portion of the top side of the heat exchanger, the outlet header receiving air from the outlet of the primary heat exchanger, the outlet header including:

a unitary body including a front side disposed proximate the front side of the heat exchanger, an opposing rear side disposed distal the front side of the heat exchanger, a first side wall and an opposing second side wall, wherein a bottom of the unitary body is rectangular and forms an exterior boarder of a first opening for the outlet header, the first opening facing the outlet of the primary heat exchanger, wherein a first corner of the outlet header that is proximate the front side of the heat exchanger is disposed at a cold-cold corner of the heat exchanger, and wherein the exterior boarder of the outlet header is at least partially flanged for connecting with the top side of the heat exchanger, and the unitary body having three openings, wherein the three openings are mutually perpendicular and progressively smaller, including the first opening, a second opening that is smaller than the first opening, and a third opening that is smaller than the second opening, wherein the second opening and the third opening are circular, the second opening being an orifice of a primary conduit extending in the first direction from the rear wall of the unitary body, wherein the first opening directs cooled air from the primary hot circuit within the heat exchanger through the second opening, and the third opening being an orifice of a first leg of an L-tube extending into the first side wall of the unitary body proximate the cold-cold corner of the heat exchanger, wherein a second leg of the L-tube extends downwardly toward the bottom of the unitary body to capture cool air from the cold-cold corner and to direct the cool air to out of the primary heat exchanger through a flow-tap-off duct fluidly connected to the first leg of the L-tube.

2. The heat exchanger of claim 1, wherein the cold-cold corner is defined by a volume of an interior of the heat exchanger that is located most closely to a cool-air source upon entrance of corresponding cool air into the heat exchanger and opposite a source of hot-air flow upon entrance of bleed air into the heat exchanger.

3. The heat exchanger of claim 1, wherein the first leg is matingly received in the flow-tap-off duct such that a first end of the first leg sits slightly inboard of a free end of the flow-tap-off duct and a second end of the first leg extends at least slightly into an interior of the outlet header.

4. The heat exchanger of claim 3, wherein the second leg is positioned within the interior of the outlet header and spaced from an interior side of the outlet header.

5. The heat exchanger of claim 1, wherein the first leg defines a pair of opposed holes receives a fastener for mechanically installing the L-tube to the flow-tap-off duct and, thus, outlet header.

6. The heat exchanger of claim 5, wherein the fastener is a rivet disposed in each of the holes.

7. The heat exchanger of claim 5, wherein the fastener is a combination of a bolt, nut, and curved washer.

8. The heat exchanger of claim 5, wherein the L-tube is retrofitted to an existing flow-tap-off duct.

9. The heat exchanger of claim 1, wherein epoxy fills any gaps between the first leg and flow-tap-off duct in the installation and acts as a secondary form of retention between the first leg and flow-tap-off duct.

* * * * *